US007150675B2

(12) United States Patent
Kramer et al.

(10) Patent No.: US 7,150,675 B2
(45) Date of Patent: Dec. 19, 2006

(54) METHOD AND SYSTEM FOR CONTROLLING THE CHEMICAL MECHANICAL POLISHING BY USING A SENSOR SIGNAL OF A PAD CONDITIONER

(75) Inventors: Jens Kramer, Dresden (DE); Uwe Gunter Stoeckgen, Dresden (DE); Jens Kunath, Wachau (DE)

(73) Assignee: Advanced Micro Devices, Inc., Austin, TX (US)

( * ) Notice: Subject to any disclaimer, the term of this patent is extended or adjusted under 35 U.S.C. 154(b) by 129 days.

(21) Appl. No.: 10/747,723

(22) Filed: Dec. 29, 2003

(65) Prior Publication Data

US 2004/0242122 A1 Dec. 2, 2004

(30) Foreign Application Priority Data

May 28, 2003 (DE) ..... 103 24 429

(51) Int. Cl.
*B24B 49/00* (2006.01)

(52) U.S. Cl. ..... 451/8; 451/11; 451/56; 451/285; 451/443

(58) Field of Classification Search ..... 451/5, 451/8, 11, 56, 285–289, 444, 443
See application file for complete search history.

(56) References Cited

U.S. PATENT DOCUMENTS

| | | | | |
|---|---|---|---|---|
| 5,860,847 | A * | 1/1999 | Sakurai et al. | 451/10 |
| 6,306,008 | B1 * | 10/2001 | Moore | 451/5 |
| 6,336,842 | B1 * | 1/2002 | Ootsuki et al. | 451/21 |
| 6,494,765 | B1 * | 12/2002 | Gitis et al. | 451/5 |
| 6,905,571 | B1 * | 6/2005 | Sakuma et al. | 156/345.13 |
| 2003/0013394 | A1 | 1/2003 | Choi et al. | 451/443 |
| 2004/0089070 | A1 * | 5/2004 | Elledge | 73/579 |

FOREIGN PATENT DOCUMENTS

| | | |
|---|---|---|
| WO | WO 01/58644 A1 | 8/2001 |
| WO | WO 02/38336 A1 | 5/2002 |

* cited by examiner

*Primary Examiner*—M. Rachuba
(74) *Attorney, Agent, or Firm*—Williams, Morgan & Amerson, P.C.

(57) ABSTRACT

In a system and a method according to the present invention, a sensor signal, such as a motor current signal, from a drive assembly of a pad conditioning system is used to estimate the status of one or more consumables in a CMP system.

13 Claims, 2 Drawing Sheets

METHOD AND SYSTEM FOR CONTROLLING THE CHEMICAL MECHANICAL POLISHING BY USING A SENSOR SIGNAL OF A PAD CONDITIONER

BACKGROUND OF THE INVENTION

1. Field of the Invention

The present invention relates to the field of fabrication of microstructures, and, more particularly, to a tool for chemically mechanically polishing (CMP) substrates bearing, for instance, a plurality of dies for forming integrated circuits, wherein the tool is equipped with a conditioner system for conditioning the surface of a polishing pad of the tool.

2. Description of the Related Art

In microstructures such as integrated circuits, a large number of elements, such as transistors, capacitors and resistors, are fabricated on a single substrate by depositing semiconductive, conductive and insulating material layers and patterning these layers by photolithography and etch techniques. Frequently, the problem arises that the patterning of a subsequent material layer is adversely affected by a pronounced topography of the previously formed material layers. Moreover, the fabrication of microstructures often requires the removal of excess material of a previously deposited material layer. For example, individual circuit elements may be electrically connected by means of metal lines that are embedded in a dielectric, thereby forming what is usually referred to as a metallization layer. In modern integrated circuits, a plurality of such metallization layers is typically provided, which must be stacked on top of each other to maintain the required functionality. The repeated patterning of material layers, however, creates an increasingly non-planar surface topography, which may deteriorate subsequent patterning processes, especially for microstructures including features with minimum dimensions in the submicron range, as is the case for sophisticated integrated circuits.

It has thus turned out to be necessary to planarize the surface of the substrate between the formation of specific subsequent layers. A planar surface of the substrate is desirable for various reasons, one of them being the limited optical depth of the focus in photolithography which is used to pattern the material layers of microstructures.

Chemical mechanical polishing (CMP) is an appropriate and widely used process to remove excess material and to achieve global planarization of a substrate. In the CMP process, a wafer is mounted on an appropriately formed carrier, a so-called polishing head, and the carrier is moved relative to a polishing pad while the wafer is in contact with the polishing pad. A slurry is supplied to the polishing pad during the CMP process and contains a chemical compound reacting with the material or materials of the layer to be planarized by, for example, converting the material into an oxide, while the reaction product, such as the metal oxide, is then mechanically removed with abrasives contained in the slurry and/or the polishing pad. To obtain the required removal rate while at the same time achieving a high degree of planarity of the layer, parameters and conditions of the CMP process must be appropriately chosen, thereby considering factors such as construction of the polishing pad, type of slurry, pressure applied to the wafer while moving relative to the polishing pad and the relative velocity between the wafer and the polishing pad. The removal rate further significantly depends on the temperature of the slurry, which in turn is significantly affected by the amount of friction created by the relative motion of the polishing pad and the wafer, the degree of saturation of the slurry with ablated particles and, in particular, the state of the polishing surface of the polishing pad.

Most polishing pads are formed of a cellular microstructure polymer material having numerous voids which are filled by the slurry during operation. A densification of the slurry within the voids occurs due to the absorbed particles that have been removed from the substrate surface and accumulated in the slurry. As a consequence, the removal rate steadily decreases, thereby disadvantageously affecting the reliability of the planarizing process and thus reducing yield and reliability of the completed semiconductor devices.

To partly overcome this problem, a so-called pad conditioner is typically used that "reconditions" the polishing surface of the polishing pad. The pad conditioner includes a conditioning surface that may be comprised of a variety of materials, e.g., diamond that is covered in a resistant material. In such cases, the exhausted surface of the pad is ablated and/or reworked by the relatively hard material of the pad conditioner once the removal rate is assessed to be too low. In other cases, as in sophisticated CMP apparatuses, the pad conditioner is continuously in contact with the polishing pad while the substrate is polished.

In sophisticated integrated circuits, process requirements concerning uniformity of the CMP process are very strict so that the state of the polishing pad has to be maintained as constant as possible over the entire area of a single substrate as well as for the processing of as many substrates as possible. Consequently, the pad conditioners are usually provided with a drive assembly and a control unit that allow the pad conditioner, that is, at least a carrier including the conditioning surface, to be moved with respect to the polishing head and the polishing pad to rework the polishing pad uniformly while avoiding interference with the movement of the polishing head. Therefore, one or more electric motors are typically provided in the conditioner drive assembly to rotate and/or sweep the conditioning surface suitably.

One problem with conventional CMP systems resides in the fact that consumables, such as the conditioning surface, the polishing pad, components of the polishing head, and the like, have to be replaced on a regular basis. For instance, diamond-comprising conditioning surfaces may typically have lifetimes of less than 2,000 substrates, wherein the actual lifetime depends on various factors that make it very difficult to predict the appropriate time for replacement. Generally, replacing the consumables at an early stage significantly contributes to the cost of ownership and a reduced tool availability, whereas a replacement in a very advanced stage of one or more of the consumables of a CMP system may jeopardize process stability. Moreover, the deterioration of the consumables renders it difficult to maintain process stability and to reliably predict an optimum time point for consumable replacement.

In view of the above-mentioned problems, there exists a need for an improved control strategy in CMP systems, wherein the behavior of consumables is taken into account.

SUMMARY OF THE INVENTION

Generally, the present invention is directed to a technique for controlling a CMP system on the basis of a signal representing the status of a drive assembly coupled to a pad conditioner, wherein the signal provided by the drive assembly may be used to indicate the current tool status and/or to estimate a remaining lifetime of one or more consumables of the CMP system and/or to improve the quality of the CMP process control. To this end, the signal delivered by the drive assembly of the pad conditioner may serve as a "sensor" signal containing information on the current status of the conditioning surface, which may in turn be assessed for predicting the lifetime and/or readjusting one or more process parameters of the CMP process. Since the frictional force created by the relative motion between a conditioning surface and a polishing pad is substantially insensitive to short-term fluctuations, contrary to the frictional force between a substrate and the polishing pad, any signal indicative of this frictional force may efficiently be employed for estimating the status of the conditioning surface. According to the present invention, the drive assembly of the pad conditioner is used as a source for generating a signal indicating the frictional force, thereby serving as a "status" sensor of at least the conditioning surface of the pad conditioner.

According to one illustrative embodiment of the present invention, a system for chemical mechanical polishing comprises a movable and actuable polishing head configured to receive and hold in place a substrate. Moreover, a polishing pad is provided that is mounted on a platen which is coupled to a first drive assembly. A pad conditioning assembly is coupled to a second drive assembly. A control unit is operatively connected to the polishing head and the first and second drive assemblies, wherein the control unit is configured to control the operation of the first and second drive assemblies and to provide, upon receiving a sensor signal from the second drive assembly, an indication for at least one characteristic of a consumable member of the CMP system.

In accordance with another illustrative embodiment of the present invention, a method of operating a CMP system comprises obtaining a sensor signal from an electric drive assembly driving a pad conditioner of the CMP system and estimating a condition of the pad conditioner on the basis of the sensor signal.

According to yet another illustrative embodiment of the present invention, a method of estimating a lifetime of consumables in a CMP system comprises determining the status of a first conditioning surface of a pad conditioner at a plurality of time points while using the first conditioning surface under predefined operating conditions of the CMP system. Then, a relationship is established between the status determined for each time point and a sensor signal indicating at least one parameter of a drive assembly for driving the pad conditioner. Finally, the sensor signal is assessed, when operating the CMP system under the predefined operating conditions with a second conditioning surface, on the basis of the relationship to thereby estimate a remaining lifetime of at least one consumable member of the CMP system.

In accordance with still another illustrative embodiment, a method of controlling a process sequence including a CMP process comprises obtaining a signal from a conditioner drive assembly of a CMP system, wherein the signal is indicative of at least one of a motor torque and a speed of a motor of the drive assembly. Additionally, at least one process parameter is adjusted in the process sequence on the basis of the signal.

BRIEF DESCRIPTION OF THE DRAWINGS

The invention may be understood by reference to the following description taken in conjunction with the accompanying drawings, in which like reference numerals identify like elements, and in which.

Figure 1:
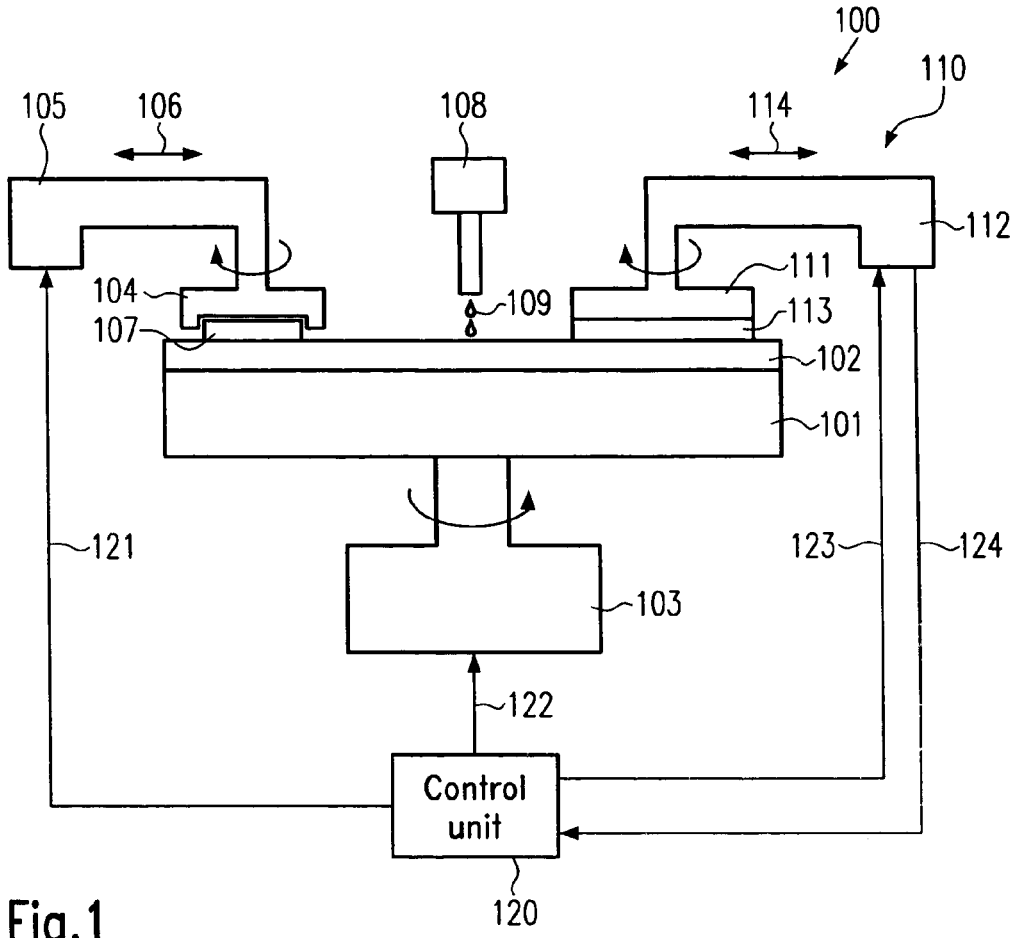
FIG. 1 shows a sketch of a CMP system according to illustrative embodiments of the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present invention will now be described with reference to the attached figures. Although the various regions and structures of a semiconductor device are depicted in the drawings as having very precise, sharp configurations and profiles, those skilled in the art recognize that, in reality, these regions and structures are not as precise as indicated in the drawings. Additionally, the relative sizes of the various features and doped regions depicted in the drawings may be exaggerated or reduced as compared to the size of those features or regions on fabricated devices. Nevertheless, the attached drawings are included to describe and explain illustrative examples of the present invention. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

With reference to the drawings, further illustrative embodiments of the present invention will now be described in more detail. FIG. 1 schematically represents a CMP system 100 in accordance with the present invention. The CMP system 100 comprises a platen 101 on which a polishing pad 102 is mounted. The platen 101 is rotatably attached to a drive assembly 103 that is configured to rotate the platen 101 at any desired revolution between a range of zero to some hundred revolutions per minute. A polishing head 104 is coupled to a drive assembly 105, which is adapted to rotate the polishing head 104 and to move it radially with respect to the platen 101 as is indicated by 106.

Furthermore, the drive assembly 105 may be configured to move the polishing head 104 in any desired manner necessary to load and unload a substrate 107, which is received and held in place by the polishing head 104. A slurry supply 108 is provided and positioned such that a slurry 109 may appropriately be supplied to the polishing pad 102.

The CMP system 100 further comprises a conditioning system 110 which will also be referred to hereinafter as a pad conditioner 110 including a head 111 attached to which is a conditioning member 113 including a conditioning surface comprised of an appropriate material such as diamond, having a specified texture designed to obtain an optimum conditioning effect on the polishing pad 102. The head 111 is connected to a drive assembly 112, which, in turn, is configured to rotate the head 111 and move it radially with respect to the platen 101 as is indicated by the arrow 114. Moreover, the drive assembly 112 may be configured so as to provide the head 111 with any movability required for yielding the appropriate conditioning effect.

The drive assembly 112 comprises at least one electric motor of any appropriate construction to impart the required functionality to the pad conditioner 110. For instance, the drive assembly 112 may include any type of DC or AC servo motor. Similarly, the drive assemblies 103 and 105 may be equipped with one or more appropriate electric motors.

The CMP system 100 further comprises a control unit 120, which is operatively connected to the drive assemblies 103, 105 and 112. The control unit 120 may also be connected to the slurry supply 108 to initiate slurry dispense. The control unit 120 may be comprised of two or more sub-units that may communicate with appropriate communications networks, such as cable connections, wireless networks and the like. For instance, the control unit 120 may comprise a sub-control unit as is provided in conventional CMP systems so as to appropriately provide control signals 121, 122 and 123 to the drive assemblies 105, 103 and 112, respectively, so as to coordinate the movement of the polishing head 104, the polishing pad 102 and the pad conditioner 110. The control signals 121, 122 and 123 may represent any suitable signal form to instruct the corresponding drive assemblies to operate at the required rotational and/or translatory speeds.

Contrary to conventional CMP systems, the control unit 120 is configured to receive and process a signal 124 from the drive assembly 112, which basically indicates a frictional force acting between the polishing pad 102 and the conditioning member 113 during operation. Therefore, the signal 124 is also referred to as a "sensor" signal. The ability of receiving and processing the sensor signal 124 may be implemented in the form of a corresponding sub-unit, a separate control device, such as a PC, or as a part of a facility management system. Data communication to combine the conventional process control functions with the sensor signal processing may be obtained by the above communications networks.

During the operation of the CMP system 100, the substrate 107 may be loaded onto the polishing head 104, which may have been appropriately positioned so as to receive the substrate 107 and convey it to the polishing pad 102. It should be noted that the polishing head 104 typically comprises a plurality of gas lines supplying vacuum and/or gases to the polishing head 104 so as to fix the substrate 107 and to provide a specified downforce during the relative motion between the substrate 107 and the polishing pad 102.

The various functions required for properly operating the polishing head 104 may also be controlled by the control unit 120. The slurry supply 108 is actuated, for example, by the control unit 120 so as to supply the slurry 109 that is distributed across the polishing pad 102 upon rotating the platen 101 and the polishing head 104. The control signals 121 and 122 supplied to the drive assemblies 105 and 103, respectively, effect a specified relative motion between the substrate 107 and the polishing pad 102 to achieve a desired removal rate, which depends, as previously explained among others, on the characteristics of the substrate 107, the construction and current status of the polishing pad 102, the type of slurry 109 used, and the downforce applied to the substrate 107. Prior to and/or during the polishing of the substrate 107, the conditioning member 113 is brought into contact with the polishing pad 102 so as to rework the surface of the polishing pad 102. To this end, the head 111 is rotated and/or swept across the polishing pad 102, wherein, for example, the control unit 120 provides the control signal 123 such that a substantially constant speed, for example, a rotational speed, is maintained during the conditioning process. Depending on the status of the polishing pad 102 and the conditioning surface of the member 113, for a given type of slurry 109, a frictional force acts and requires a specific amount of motor torque to maintain the specified constant rotational speed.

Contrary to the frictional force acting between the substrate 107 and the polishing pad 102, which may significantly depend on substrate specifics and may, therefore, greatly vary during the polishing process of a single substrate, the frictional force between the conditioning member 113 and the polishing pad 102 is substantially determined by a "long term" development of the pad and conditioning member status without responding to substrate-based short-term fluctuations. For instance, during the progress of the conditioning process for a plurality of substrates 107, a sharpness of the surface texture of the conditioning member 113 may deteriorate, which may lead to a decrease of the frictional force between the pad 102 and the conditioning member 113. Consequently, the motor torque and thus the motor current required to maintain the rotational speed constant also decreases. Thus, the value of the motor torque conveys information on the frictional force and depends on the status at least of the conditioning member 113. The sensor signal 124, for example representing the motor torque or motor current, is received by the control unit 120 and is processed so as to estimate the current status of at least the conditioning member 113. Thus, in one embodiment of the present invention, the motor torque may represent a characteristic of the conditioning member 113 to estimate the current status thereof. That is, the motor torque characterizes the frictional force and, thus, the conditioning effect currently provided by the conditioning member 113.

Upon receiving and processing, for example comparing with a threshold value, the control unit 120 may then indicate whether or not the current status of the conditioning member 113 is valid, i.e., is considered appropriate to provide the desired conditioning effect. Moreover, in other embodiments, the control unit 120 may estimate the remaining lifetime of the conditioning member 113, for example by storing previously obtained motor torque values and interpolating these values for the further conditioning time on the basis of appropriate algorithms, and/or on the basis of reference data previously obtained, as will be described in more detail with reference to FIG. 2.

Figure 2:
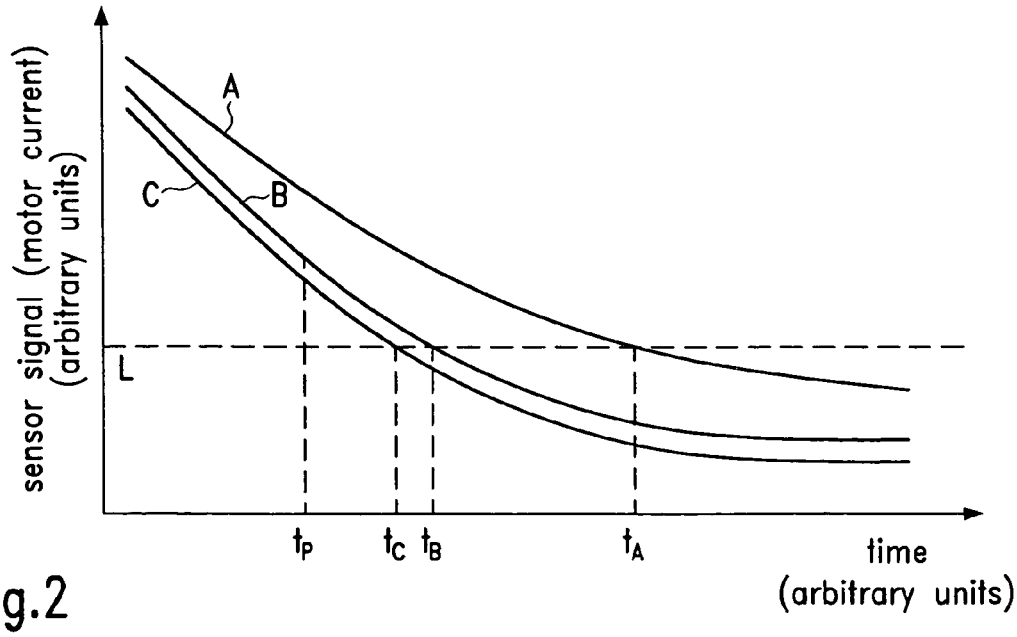
FIG. 2 shows a graph illustrating the relationship between the motor current of a conditioner drive assembly versus the conditioning time.

FIG. 2 schematically shows a graph illustrating the dependence of the motor current of the drive assembly 112 versus the conditioning time for specified operating conditions of the CMP system 100. Under specified operating conditions, it is meant that a specified type of slurry 109 is provided during the conditioning process, wherein the rotational speed of the platen 101 and that of the head 111 are maintained substantially constant. Moreover, in obtaining representative data or reference data for the motor current, the CMP system 100 may be operated without a substrate 107 so as to minimize the dependence of pad deterioration for estimating the status of the conditioning member 113. In other embodiments, a product substrate 107 or a dedicated test substrate may be polished to thereby simultaneously obtain information on the status of the polishing pad 102 and the conditioning member 113, as will be explained later on.

FIG. 2 shows the sensor signal 124, in this embodiment representing the motor current, for three different conditioning members 113 with respect to the conditioning time. As indicated, the motor current values may be obtained at discrete time points or may be obtained substantially continuously, depending on the capability of the control unit 120 in processing the sensor signal 124 and on the capability of the drive assembly 112 to provide the sensor signal 124 in a time discrete manner or in a substantially continuous manner. In other embodiments, smooth motor current curves may be obtained by interpolating or otherwise employing fit algorithms to discrete motor current values.

In FIG. 2, curves A, B and C represent the respective sensor signals 124 of the three different conditioning members 113, wherein in the present example it is assumed that the curves A, B and C are obtained with polishing pads 102 that may frequently be replaced so as to substantially exclude the influence of pad deterioration on the motor current. Curve A represents a conditioning member 113 requiring a larger amount of motor current over the entire conditioning time compared to the conditioning members 113 represented by the curves B and C. Thus, the frictional force and, hence, the conditioning effect of the conditioning member 113 represented by curve A may be higher than the conditioning effect provided by the conditioning members 113 represented by curves B and C. The dashed line, indicated as L, may represent the minimum motor current and thus, the minimum conditioning effect that is at least required to provide what is considered to be sufficient to guarantee process stability during polishing the substrate 107. Consequently, three time points $t_A$, $t_B$, $t_C$ indicate the respective useful lifetimes of the three conditioning members 113 represented by the curves A, B and C.

In case the curves A, B and C are obtained by simultaneously polishing actual product substrates 107, the control unit 120 may indicate an invalid system status once the corresponding time points $t_A$, $t_B$, $t_C$ are reached.

In other embodiments, the remaining lifetime of the conditioning member 113 may be predicted by the control unit 120 on the basis of the sensor signal 124 in that the preceding progression of the motor current is assessed and used to interpolate the behavior of the corresponding motor current curve in the future. Assume, for example, the sensor signal 124 follows curve B in FIG. 2 and, at a time point $t_p$, a prediction regarding the remaining lifetime of the conditioning member 113 is requested, for instance, to coordinate the maintenance of various components of the CMP system 100 or to estimate the tool availability when establishing a process plan for a certain manufacturing sequence. From the preceding progression and slope of curve B, the control unit 120 may then determine, for example by interpolation, a reliable estimation of the difference $t_B - t_P$, i.e., the remaining useful life of the conditioning member. The prediction of the control unit 120 may further be based on the "experience" of other motor current curves having a very similar progression during the initial phase $t_P$. To this end, a library of curves representing the sensor signal 124 may be generated, wherein the sensor signal 124, for example the motor current, is related to the corresponding conditioning time for specified operating conditions of the CMP system 100. By using the library as reference data, the reliability of the predicted remaining lifetime gains in consistency with an increasing amount of data entered into the library. Moreover, from a plurality of representative curves, such as the curves A, B and C, an averaged behavior of the further development at any given time point may be established so as to further improve the reliability in predicting a remaining lifetime of the conditioning member 113.

As previously pointed out, the frictional force may also depend on the current status of the polishing pad 102 and thus the deterioration of the polishing pad 102 may also contribute to the progression of the sensor signal 124 over time. Since the polishing pad 102 and the conditioning member 113 may have significantly different lifetimes, it may be advantageous to obtain information of the status of both the conditioning member 113 and the polishing pad 102 so as to be able to separately indicate a required replacement of the respective component. Hence, in one illustrative embodiment of the present invention, a relationship is established between the sensor signal 124, that is in one example the motor current signal, over time with respect to the deterioration of the polishing pad 102. To this end, a specified CMP process, i.e., a predefined CMP recipe, may be performed for a plurality of substrates, wherein frequently the conditioning member 113 is replaced so as to minimize the influence of deterioration of the conditioning member 113 on the measurement results.

Figure 3:
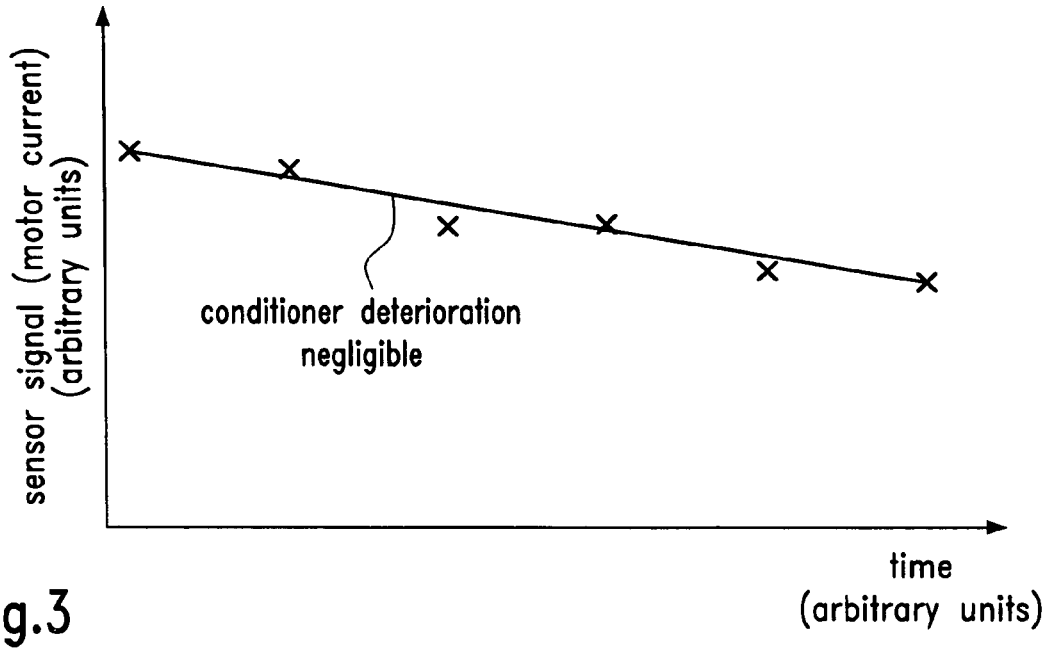
FIG. 3 represents a plot of the motor current of a conditioner drive assembly versus time while polishing a substrate under substantially stable conditioning conditions.

FIG. 3 schematically illustrates, in an exemplary manner, the sensor signal 124 obtained over time, indicating a decreasing frictional force between the conditioning member 113 and the polishing pad 102, wherein it may be assumed that the reduction of the conditioning effect may substantially be caused by an alteration of the surface of the polishing pad 102. In the present example, the pad deterioration may result in a slight decrease of the motor current signal, whereas, in other CMP processes, a different behavior may result. It should be noted that any type of signal variation of the sensor signal 124 may be used to indicate the status of the polishing pad 102 as long as an unambiguous, that is, a substantially monotonous behavior of the sensor signal 124 over time, at least within some specified time intervals, is obtained. As previously pointed out with reference to FIG. 2, a plurality of polishing pads 102 and a plurality of different CMP processes may be investigated so as to establish a library of reference data, or to continuously update any parameters used in the control unit 120 for assessing the current status of consumables of the CMP system 100.

In one illustrative embodiment, the measurement results represented in FIG. 3 may be combined with the measurement data of FIG. 2, thereby enabling the control unit 120 to estimate the remaining useful lifetime of both the polishing pad 102 and the conditioning member 113. For instance, the control unit 120 may be adapted to monitor precisely time periods when the polishing pad 102 and the conditioning member 113 are used. From the measurement results in FIG. 2, representing the deterioration of the conditioning member 113 substantially without the influence of any pad alterations, a slightly enhanced decrease of the sensor signal 124 may then be expected owing to the additional reduction of the sensor signal 124 caused by the additional deterioration of the polishing pad 102. Thus, an actual sensor signal 124, obtained during the polish of a plurality of substrates without replacing the conditioning member 113 and the polishing pad 102, may result in curves similar to those shown in FIG. 2 except for a somewhat steeper slope of these curves over the entire lifetime. Thus, by comparing actual sensor signals 124 with representative curves, such as shown in FIG. 2, and with representative curves, such as those shown in FIG. 3, a current status of both the polishing pad 102 and the conditioning member 113 may be estimated.

Moreover, the sensor signal 124 may also be recorded for actual CMP processes and may be related to the status of the consumables of the CMP station 100 after replacement, to thereby enhance the "robustness" of the relationship between the sensor signal 124 and the current status of a consumable during actual CMP processes. For instance, the progression of a specified sensor signal 124 may be evaluated after the replacement of the conditioning member 113, which may have been initiated by the control unit 120 on the basis of the considerations explained above, wherein the actual status of the conditioning member 113 and possibly of other consumables, such as the polishing pad 102, are taken into consideration. If the inspection of the conditioning member 113 and possibly of other consumables indicates a status that is not sufficiently correctly represented by the sensor signal 124, for example, the limit L in FIG. 2 may correspondingly be adapted. In this way, the control unit 120 may continuously be updated on the basis of the sensor signal 124.

It should be noted that in the embodiments described so far, the sensor signal 124 represents the motor current of at least one electric motor in the drive assembly 112. In other embodiments, the sensor signal may be represented by any appropriate signal indicating an interaction between the conditioning member 113 and the polishing pad 102. For instance, the control unit 120 may supply a constant current or a constant voltage, depending on the type of motor used in the drive assembly 112, and may then use the "response" of the drive assembly 112 with respect to an alteration in the interaction between the conditioning member 113 and the polishing pad 102. For instance, if an AC-type servo motor is used in the drive assembly 112, a constant current supplied thereto may result in an increase of the rotational speed, when the frictional force decreases upon deterioration of the conditioning member 113 and/or the polishing pad 102. The change in the rotational speed may then be used as an indicator of the current status similarly as is explained with reference to FIGS. 2 and 3.

Figure 4:
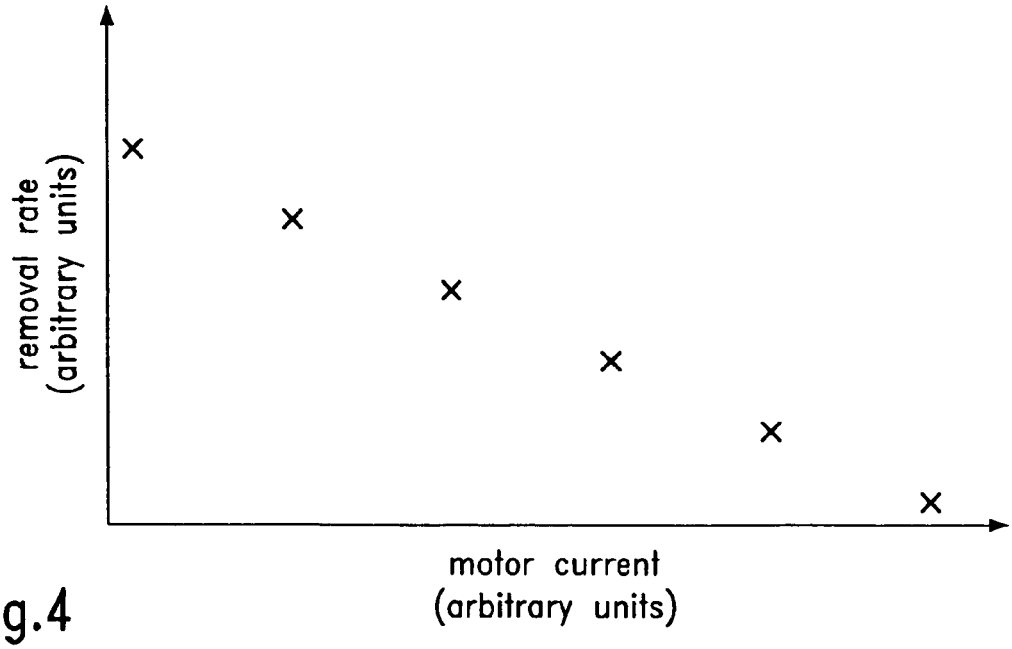
FIG. 4 schematically shows a graph depicting the dependence of a specified characteristic of a conditioning surface, for example represented by a removal rate obtained by conditioning a polishing pad under predefined operating conditions, versus the motor current for driving the conditioning surface.

With reference to FIG. 4, further illustrative embodiments of the present invention will now be described, wherein the control unit 120 additionally or alternatively includes the function of controlling the CMP process on the basis of the sensor signal 124. As previously explained, the deterioration of one of the consumables of the CMP system 100, for instance of the conditioning member 113, may affect the performance of the CMP system 100, even if the usable lifetime is still in its allowable range. In order to obtain a relationship between the performance of the CMP system 100 and the sensor signal 124, for instance provided in the form of the motor current signal, one or more representative parameters may be determined in relation to the signal 124. In one embodiment, a global removal rate for a specified CMP recipe may be determined with respect to the corresponding sensor signal obtained from the drive assembly 112. To this end, one or more test substrates may be polished, for example intermittently with product substrates, to determine a removed thickness of a specified material layer. Concurrently, the corresponding sensor signal 124 is recorded. The test substrates may have formed thereon a relatively thick non-patterned material layer so as to minimize substrate-specific influences.

FIG. 4 schematically shows a plot qualitatively depicting the dependence of the removal rate for a specified CMP recipe and a specified material layer from the motor current as one example of the sensor signal 124. From the measurement data, a corresponding relationship between the sensor signal 124 and the CMP specific characteristic may then be established. That is, in the example shown in FIG. 4, each motor current value represents a corresponding removal rate of the CMP system 100. This relationship may then be implemented in the control unit 120, for instance in the form of a table or a mathematical expression and the like, so as to control the CMP system 100 on the basis of the sensor signal 124. For example, if a sensor signal 124 is detected by the control unit 120 indicating a decrease of the removal rate of the CMP system 100, the control unit 120 may instruct the polishing head 104 to correspondingly increase the downforce applied to the substrate 107. In other cases, the relative speed between the polishing head 104 and the polishing pad 102 may be increased so as to compensate for the decrease of the removal rate. In a further example, the total polish time may be adapted to the currently prevailing removal rate indicated by the sensor signal 124.

In other embodiments, representative characteristics of the CMP system 100 other than the removal rate may be related to the sensor signal 124. For instance, the duration of the polishing process, i.e., polish time, may be determined for a specified product or test substrate and may be related to the sensor signal 124 as received during the polish time for the specific substrate so that, in an actual CMP process, the sensor signal 124 obtained by the control unit 120 may then be used to adjust the polish time based on the determined relation for the currently processed substrate. Consequently, by using the sensor signal 124 alternatively or in addition to estimating the status of consumables, the process control may be carried out on a run-to-run basis, thereby significantly enhancing process stability. In other embodiments, the sensor signal 124 may also be used as a status signal representing not only the status of one or more consumables but also the currently prevailing performance of the CMP system 100, wherein this status signal may be supplied to a facility management system or to a group of associated process and metrology tools to thereby improve the control of a complex process sequence by commonly assessing the status of the various process and metrology tools involved and correspondingly adjusting one or more process parameters thereof. For instance, a deposition tool may be correspondingly controlled on the basis of the sensor signal 124 so as to adapt the deposition profile to the current CMP status. Assume that, a correlation between the sensor signal 124 and the polishing uniformity across a substrate diameter may have been established which may be especially important for large diameter substrates having a diameter of 200 or 300 mm. The information of the sensor signal 124 is then used to adjust the process parameters of the deposition tool, such as an electroplating reactor, to adapt the deposition profile to the currently detected polishing non-uniformity.

As a result, the present invention provides a system and a method for enhancing the performance of a CMP system or of a process tool chain including a CMP system, since a sensor signal provided by the drive assembly of a pad conditioning system is used to detect or at least estimate the current status of one or more consumables and/or the current performance status of the CMP system. Based on this sensor signal, an invalid system status and/or a remaining lifetime may be indicated and/or the control of the CMP process may be based, among others, on the sensor signal. The estimation of the status of the consumables, e.g., by predicting the remaining lifetime, allows the coordination of maintenance periods for different CMP components and/or different CMP related process tools. Thus, the cost of ownership, due to a more efficient usage of consumables is reduced while tool availability is enhanced. Using the sensor signal supplied by the pad conditioner drive assembly also improves the process stability in that CMP specific variations may be compensated for within the CMP tool and/or at one or more process tools downstream or upstream of the CMP tool.

The particular embodiments disclosed above are illustrative only, as the invention may be modified and practiced in different but equivalent manners apparent to those skilled in the art having the benefit of the teachings herein. For example, the process steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. A method of operating a CMP system, comprising:

obtaining a sensor signal from an electric drive assembly driving a pad conditioner of said CMP system;

estimating a first condition of said pad conditioner and a second condition of a polishing pad in contact with said pad conditioner on the basis of said sensor signal; and predicting a remaining lifetime of the conditioning surface of said pad conditioner on the basis of the first estimated condition and a remaining lifetime of the polishing surface of said polishing pad on the basis of the second estimated condition.

2. The method of claim 1, wherein said sensor signal is indicative of at least one of a revolution of at least one electric motor of said drive assembly and a torque of said at least one motor.

3. The method of claim 2, wherein estimating said condition of said pad conditioner includes:

establishing reference data for at least one characteristic of said pad conditioner; and comparing said sensor signal with said reference data.

4. The method of claim 3, wherein said at least one characteristic includes a frictional force acting between a conditioning surface of said pad conditioner and said polishing pad during operation of said CMP system.

5. The method of claim 1, further comprising controlling operation of said CMP system on the basis of said sensor signal.

6. The method of claim 5, wherein controlling operation of said CMP system includes readjusting at least one of a downforce, a polish time and a relative speed between a substrate and a polishing pad on the basis of said sensor signal.

7. The method of claim 5, wherein controlling operation of said CMP system includes readjusting a drive signal to said drive assembly on the basis of said sensor signal to adjust a conditioning effect.

8. A method of controlling a process sequence including a CMP process, comprising:

obtaining a signal from a conditioner drive assembly of a CMP system, said signal being indicative of at least one of a motor torque and a speed of a motor of said drive assembly;

estimating a condition of a polishing pad of said CMP system on the basis of said signal; and adjusting at least one process parameter in said process sequence on the basis of said estimated polishing pad condition.

9. The method of claim 8, wherein said at least one process parameter includes at least one of a downforce exerted between the polishing pad and a polishing head is said CMP system, a polish time and relative speed of a pad and the polishing head.

10. The method of claim 8, wherein said at least one process parameter includes a deposition specific parameter of a deposition tool arranged upstream of said CMP system.

11. The method of claim 2, wherein estimating said condition of said polishing pad includes:

establishing reference data for at least one characteristic of said polishing pad; and comparing said sensor signal with said reference data.

12. The method of claim 8, further comprising estimating a remaining lifetime of the polishing pad on the basis of said signal.

13. The method of claim 10, further comprising:

estimating a polishing profile of said polishing pad on the basis of said signal; and determining the deposition specific parameter to provide a deposition profile of a layer formed using the deposition tool consistent with the estimated polishing profile.

* * * * *